US006158507A

United States Patent [19]

Rouse et al.

[11] Patent Number: 6,158,507

[45] Date of Patent: Dec. 12, 2000

[54] WELL SCREEN

[76] Inventors: William T. Rouse, 10470 FM 149, Montgomery, Tex. 77356; Robert D. Whitworth, 7114 Huntbrook, Spring, Tex. 77379

[21] Appl. No.: 09/111,641

[22] Filed: Jul. 8, 1998

[51] Int. Cl.[7] ..... E21B 43/08

[52] U.S. Cl. ..... 166/228; 166/230; 166/236

[58] Field of Search ..... 166/228, 230, 166/234, 236; 210/484

[56] References Cited

U.S. PATENT DOCUMENTS

| | | | |
|---|---|---|---|
| 4,613,350 | 9/1986 | Forester et al. | 65/2 |
| 4,613,369 | 9/1986 | Koehler | 75/246 |
| 4,858,691 | 8/1989 | Ilfrey et al. | 166/278 |
| 5,293,935 | 3/1994 | Arterbury | 166/228 |
| 5,624,560 | 4/1997 | Voll et al. | 210/486 |
| 5,664,628 | 9/1997 | Koehler et al. | 166/369 |
| 5,782,299 | 7/1998 | Simone et al. | 166/230 |
| 5,823,260 | 10/1998 | McConnell et al. | 166/230 |

*Primary Examiner*—Hoang Dang
*Attorney, Agent, or Firm*—Jennings B. Thompson

[57] ABSTRACT

A well screen is disclosed for positioning in a well bore to screen solid particles from the fluid produced by the well comprising a base pipe having a perforated wall and threaded connections for connecting the base pipe into a pipe string, a wire screen surrounding the perforated portion of the base pipe, a thin porous membrane comprising an inner layer of cloth of woven ceramic fibers wrapped around the wire screen and covered by a porous sleeve membrane of braided ceramic fibers, means for holding the ends of the porous cloth membranes in sealing engagement with the base pipe, and a perforated tubular metal shroud surrounding the ceramic cloth membranes to protect the membranes from damage when lowered into a well bore.

5 Claims, 5 Drawing Sheets

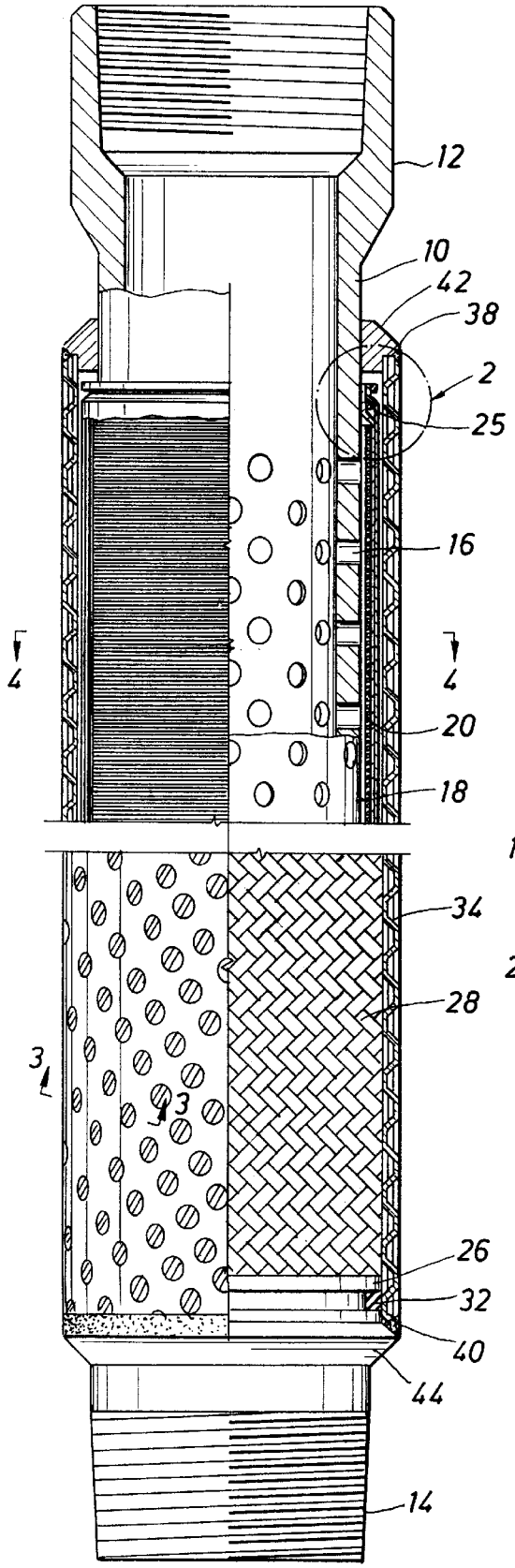
FIG. 1
FIG. 2
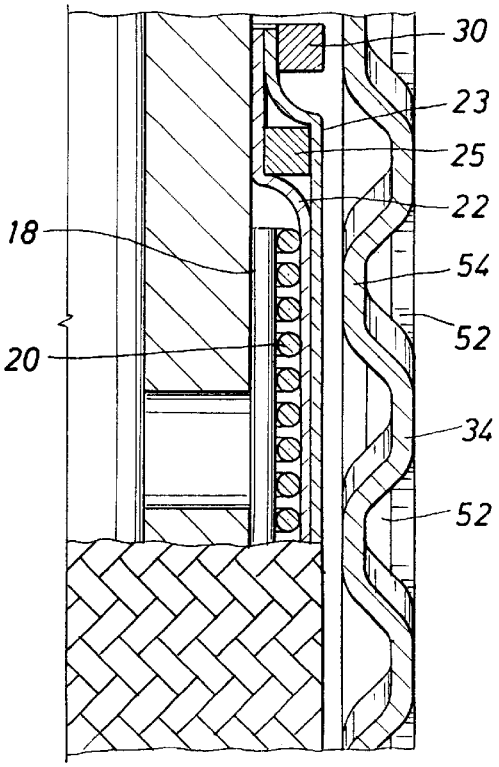

FIG. 3
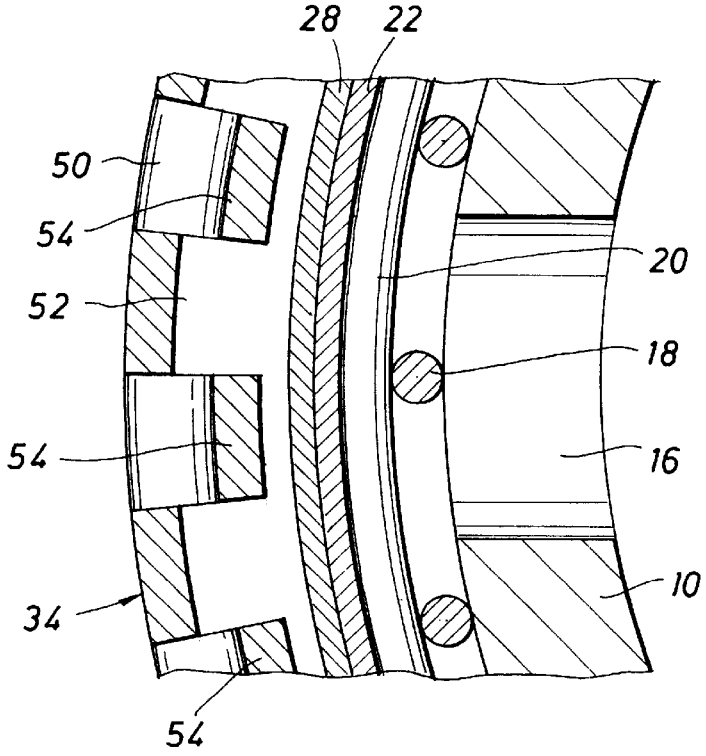
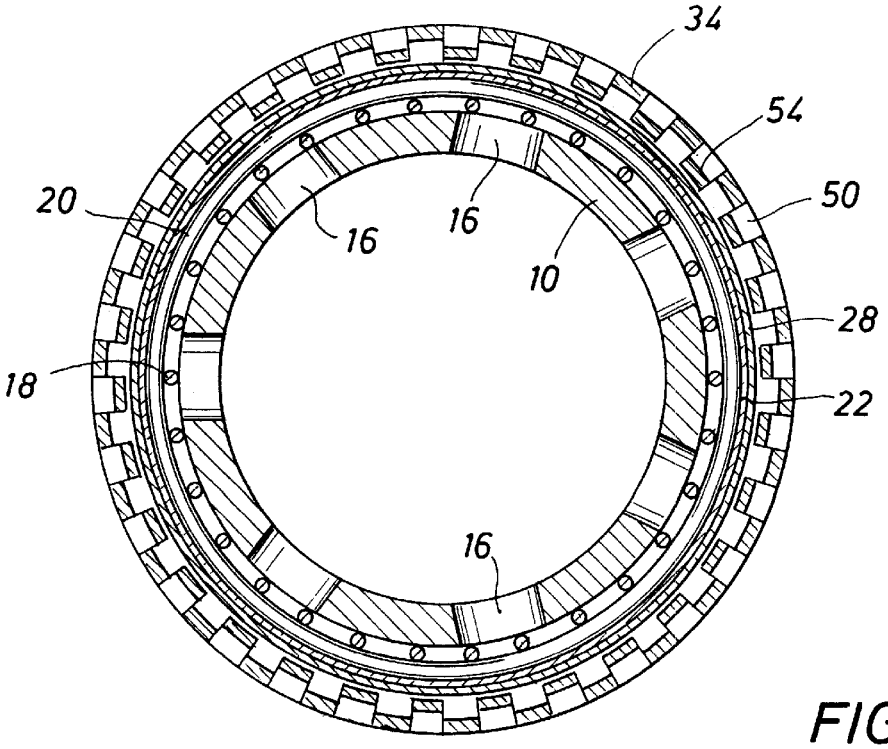
FIG. 4

| ELAPSED TIME (sec) | 30 | 60 | 90 | 120 | 150 | 180 | 210 | 240 | 270 | 300 | 330 | 360 | 390 | 420 | 450 | 480 |
|---|---|---|---|---|---|---|---|---|---|---|---|---|---|---|---|---|
| PRE-PAK Dp | 5 | 28 | 100 | | | | | | | | | | | | | |
| CB&W Dp | 2 | 2 | 2 | 3 | 4 | 4 | 5 | 6 | 7 | 8 | 10 | 15 | 30 | 34 | 68 | 100 |

| PARTICLE SIZE | 5 MICRON | 15 MICRON | 25 MICRON | 50 MICRON | 100 MICRON |
|---|---|---|---|---|---|
| CB&W RETENTION | 0 % | 82 % | 99 % | 100 % | 100 % |

| PARTICLE SIZE | 5 MICRON | 15 MICRON | 25 MICRON | 50 MICRON | 100 MICRON |
|---|---|---|---|---|---|
| CB&W RETENTION | 36% | 62% | 87% | 83% | 93% |

WELL SCREEN

This invention relates to well screens generally, and in particular, to well screens using thin, porous, flexible, membranes to screen solid particles from the well fluids flowing through the screens into the production tubing and through the tubing to the surface.

Recently Pall Well Technology came on the market with a new well screen under the trademark STRATAPAC™ DOWNHOLE MEMBRANES. The screen includes an inner perforated base pipe covered by a drainage mesh, which, in turn is covered by four layers of Pall PMM® medium, which is described as being sintered stainless steel powder having a pore structure of stainless steel woven wire mesh. This screen is described in U.S. Pat. No. 4,436,635, issued Mar. 13, 1984, entitled "Porous Metal Article and Method of Making".

Also, U.S. Pat. No. 4,858,691, which issued Aug. 22, 1989 and is assigned to Baker Hughes Incorporated, describes a well screen that employs a wire mesh of woven metal wire positioned between a perforated inner tubular member and either a wire wrapped screen or a perforated cylindrical member.

It is an object and feature of this invention to provide an improved well screen capable of surviving the multiple parameters of subsurface conditions including but not limited to: Excessive operating temperatures, corrosive and caustic chemical agents; extreme operating pressures and flexibility to pass through highly deviated bore holes.

It is an object and feature of this invention to provide an improved thin, porous, flexible membrane for use in well screens to remove all but the smallest of particles from the well fluid flowing through the membrane and a well screen that includes such a membrane.

A further object and feature of this invention is to provide an improved well screen that employs, as such a porous membrane, two layers of cloth made of fibers of inert material.

It is another object and feature of this invention to provide a well screen that includes a layer of woven fibers of inert material and a layer of braided fibers to provide a porous membrane that will screen extremely fine particles from the fluid flowing into a well bore.

A further object and feature of this invention is to provide a porous membrane for use as a component of a well screen that consists of an elongated cloth woven from continuous ceramic fibers of alumina-boria-silica that is wrapped around a supporting screen for screening relatively small particles out of the well fluid and a sleeve of braided ceramic fibers of alumina-boria-silica that covers the woven cloth to screen relatively large particles out of the well fluid, whether gas or oil or water, as the well fluid passes through the woven screen.

It is another object and feature of this invention to provide a tubular screen for screening solid particles out of fluid produced by the well that includes a porous membrane comprising two layers of cloth made of ceramic fibers.

It is another object and feature of this invention to provide a well screen for use in oil, gas, or water producing wells that includes a membrane comprising an inner layer of woven ceramic fibers and a layer of braided ceramic fibers covering the woven fiber layer.

It is another object and feature of this invention to provide a method of covering a well screen including a perforated mandrel and a rod based screen mounted on the mandrel with multiple layers of ceramic cloth comprising wrapping an elongated flat sheet of woven ceramic cloth around a well screen having a perforated pipe and an outer rod based wire screen and connecting the edges of the sheet to form a cylindrical cover for the rod based wire screen, clamping the ends of the sheet to the perforated pipe, slipping a braided tubular sleeve over the woven cylindrical cover, clamping one end of the braided sleeve to the perforated pipe to hold the end in sealing engagement with the well screen, pulling on the free end in tension to cause the braided sleeve to contract into engagement with the woven layer of ceramic cloth, and clamping the free end to the perforated pipe.

These and other objects, advantages, and features of this invention will be apparent to those skilled in the art from a consideration of this specification, including the attached drawings and appended claims.

In the Drawings:

FIG. 1 is a view partly in elevation and partly in section of the well screen of this invention.

FIG. 2 is a sectional view, on an enlarged scale, of the portion of the screen within circle 2 on FIG. 1.

FIG. 3 is a view on an enlarged scale taken along line 3—3 of FIG. 1.

FIG. 4 is a sectional view on an enlarged scale taken along line 4—4 of FIG. 1.

Figure 5:
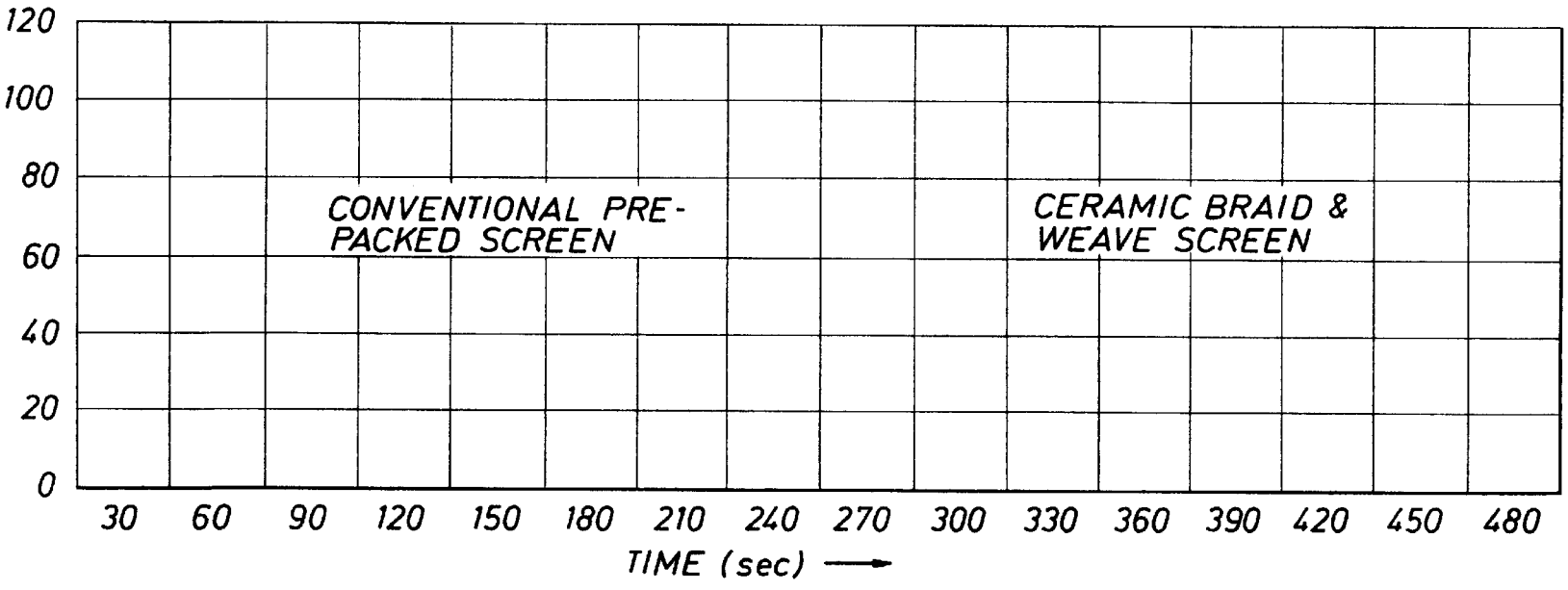

FIG. 5 shows the results of a comparison of the resistance to plugging of the screen of this invention with a conventional pre-packed screen (using resin coated sand as the filter media) when a viscous fluid comprising a mixture of a viscous gel, sold under the trademark "XANVIS", and water in which an abnormally high percentage of equal amounts of an AC coarse dust and a 70/140 gravel were suspended at a concentration of 1,500 ppm and pumped through the screens at the same volume and pressure. The screen of this invention functioned over five times as long as the conventional prepacked screen. This difference would equal years of service in a well screening normal well fluids.

Figure 6:
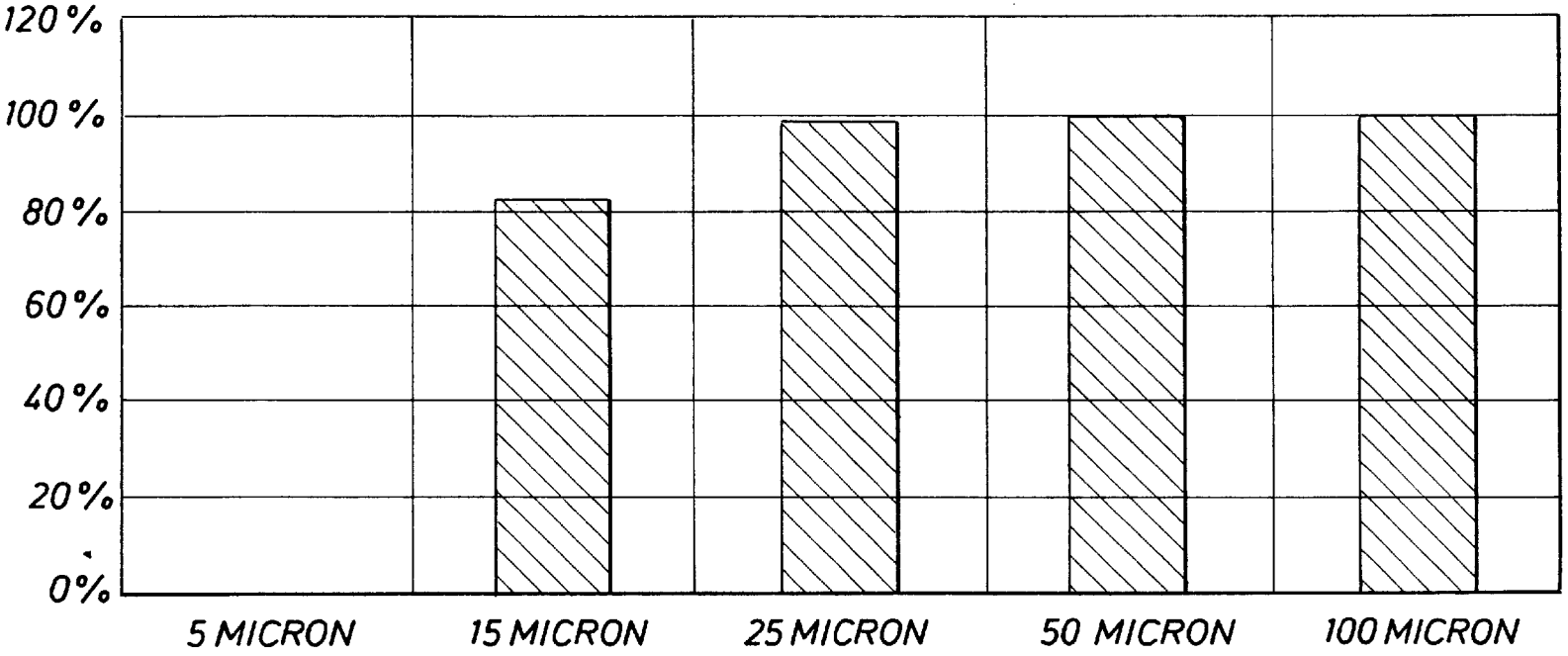

FIG. 6 shows the results of a test of the screen of this invention in which the screen is removing sand having a particle size of 100 microns and under. The test liquid was a mixture having a concentration of 1,500 ppm of 50% coarse dust and 50% 70/140 gravel in a water suspension consisting of a mixture of a gel sold under the trademark "XANVIS" and water.

Figure 7:
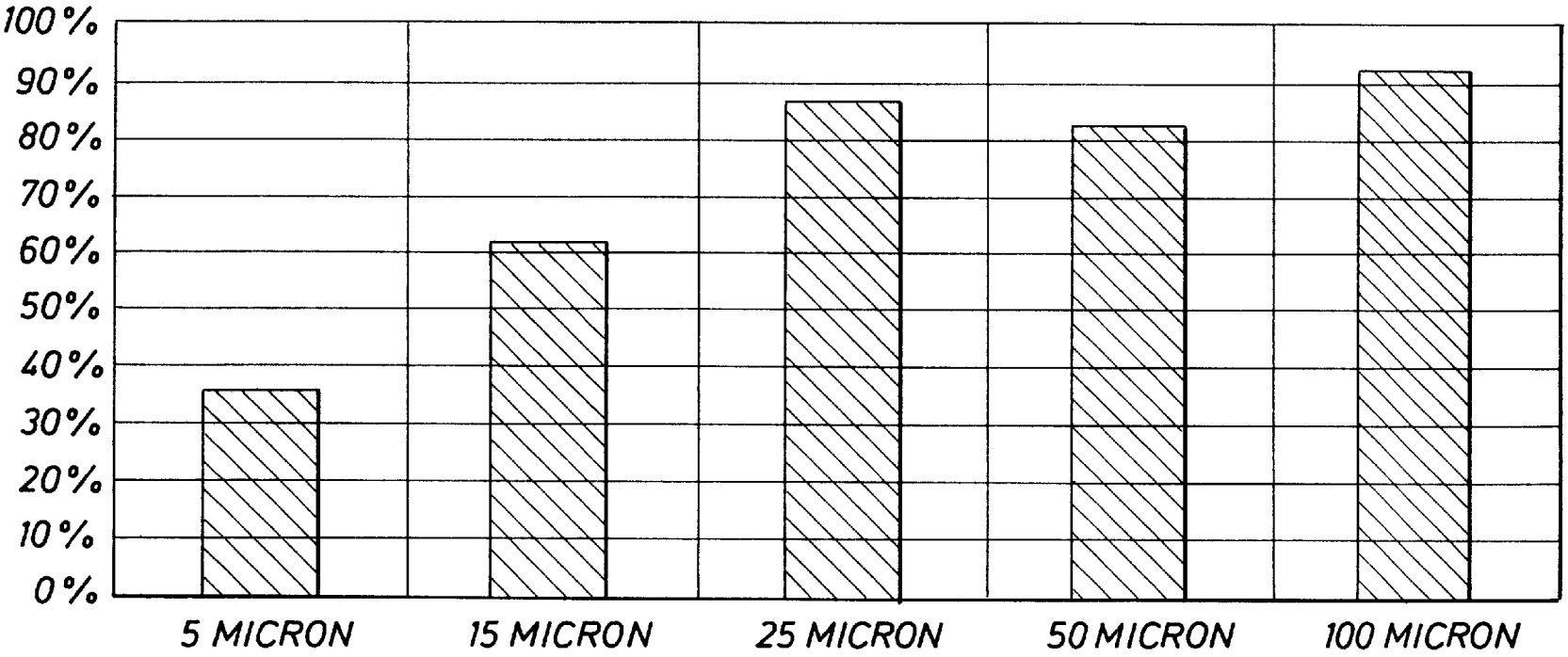

FIG. 7 shows the results of a sand control test of the screen of this invention including a simulated positioning of the screen in a horizontal hole after the screen has passed through a 100 foot long 900 bend into the horizontal well bore. The target zone was 100 micron sand. The liquid used had a concentration of 1,500 ppm made up of 50% AC coarse dust and 50% 70/140 gravel. Again the liquid was a mixture of the dust and gravel with a gel sold under the trademark "XANVIS" and water.

The well screen of FIG. 1 includes base pipe 10 having a section between box 12 attached to one end and pin 14 at the other end that is provided with a plurality of spaced perforations 16. Formed around base pipe 10 is a conventional rod based screen. In the particular embodiment shown, the rod based screen includes a plurality of spaced parallel rods 18 that extend longitudinally along the outside of the base pipe around which trapezoidal-shaped (not shown) or round wire 20 is wrapped in spaced coils. The wire is welded to the rods in accordance with the method taught in U.S. Pat. No. 4,314,129 that issued Feb. 2, 1982 to Wilson, et al. and is assigned to the assignee of this application.

In accordance with this invention, the rod base screen is covered by two porous membranes 22 and 23. Membrane 22 comprises one or two wraps of ceramic cloth 22 made of woven fibers of ceramic material, such as alumina-boria-silica fibers. Cloth 22 is cut into a rectangular shape having a width equal to the circumference of the screen so that when the cloth is wrapped around the screen the edges will abut. The edges are then connected by an adhesive and the ends are secured to the perforated mandrel by clamps 25 and 26 to hold the cloth around the screen.

The wrapped layer forming membrane 22 is covered in accordance with the invention by a second membrane comprising sleeve 28 made of braided ceramic fibers. Preferably, sleeve 28 is formed of elongated braided fibers of alumina-boria-silica. The sleeve is slipped over layer 22 of woven cloth and one end is anchored to the perforated pipe by clamp 30. Tension is then applied to the sleeve by pulling in the loose end causing the sleeve to contract and move into tight engagement with the woven fabric. The loose end is then clamped to the perforated pipe at the other end of the screen by clamp 32. Thus, the ends of wrapped layer 22 and the ends of sleeve 28 are clamped to perforated base pipe 10 to hold the membranes on the base pipe and to seal the ends of the membranes.

To protect the two membranes from damage as the screen is handled at the surface and as it is run into the well bore, shroud 34 is positioned over braided ceramic cloth sleeve 24. The shroud is attached to the base pipe by welds 38 and 40, which connect the shroud to mounting rings 42 and 44. The shroud is a tubular member in which perforations 50 are formed through which well fluid can flow into annulus 52 between the shroud and membranes. In the embodiment shown, integral arcuate metal straps 54 are formed during the perforating step. The arcuate straps divert the well fluid laterally into annulus 56 to protect the membrane from being subjected to the eroding effect of a stream of well fluid flowing directly against the membranes.

The screen tested comprised base pipe 10 of 2⅞" O.D., 6.4 lb/ft. tubing with an I.D. of 2.441". The inner screen included spaced parallel rods 18, 0.060" in diameter, and wire 20, round in cross-section and 0.060" in diameter, wrapped around the rods, multiple layers of woven ceramic cloth having an O.D. of 3.195" stretched over rod based screen 18, covered by a layer of braided ceramic fibers and louvered outer shroud 34 having an O.D. of 3.595".

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A well screen for positioning in a well bore to screen solid particles from the fluid produced by the well comprising a base pipe, a portion of the wall of which is perforated, said base pipe having threaded end connections for connecting the base pipe into a pipe string, a wire screen surrounding the perforated portion of the base pipe, a first thin porous membrane formed by a layer of cloth made of woven ceramic fibers that is wrapped around the wire screen to filter particles out of well fluid passing through the woven ceramic cloth before the fluid passes through the wire screen and enters the base pipe through the perforations, a sleeve of braided ceramic fibers extending over the layer of woven ceramic fibers, means for holding the ends of the woven ceramic cloth membrane and the sleeve of braided ceramic fibers in sealing engagement with the base pipe, and a perforated tubular metal shroud surrounding the ceramic cloth membranes to protect the membranes from damage as the screen is lowered into a well bore.

2. The well screen of claim 1 in which the wire screen is rod-based.

3. The well screen of claim 1 or 2 in which the ceramic fibers are made of alumina-boria-silica.

4. The well screen of claim 1 in which the membrane comprises two layers of woven ceramic fiber cloth wrapped around the wire screen with each layer having overlapping edges with the overlaps of each wrap spaced apart longitudinally along the screen at an angle to the longitudinal axis.

5. A well screen for positioning in a well bore to screen solid particles from the fluid produced by the well comprising a base pipe having threaded connections on opposite ends for connecting the base pipe into a pipe string, a plurality of perforations in a portion of the wall of the pipe through which formation can flow into the pipe, a rod supported wire screen surrounding the perforated portion of the base pipe, an elongated strip of woven ceramic fibers wrapped around the wire screen and an elongated braided sleeve of ceramic fibers surrounding the woven ceramic wrap to combine with the woven strip to filter particles out of well fluid passing through the braided sleeve and the woven ceramic cloth before the fluid enters the base pipe through the perforations, and a perforated tubular metal shroud surrounding the braided sleeve to protect the sleeve from damage as the screen is lowered into a well bore.

* * * * *